US008196220B2

(12) United States Patent
Rance et al.

(10) Patent No.: US 8,196,220 B2
(45) Date of Patent: Jun. 12, 2012

(54) GARMENTS

(75) Inventors: Jason Rance, London (GB); Deborah Yeomans, London (GB); Melanie Simmons, London (GB); Peter Harrison, London (GB)

(73) Assignee: Speedo International Limited, London (GB)

( * ) Notice: Subject to any disclaimer, the term of this patent is extended or adjusted under 35 U.S.C. 154(b) by 641 days.

(21) Appl. No.: 11/839,879

(22) Filed: Aug. 16, 2007

(65) Prior Publication Data

US 2008/0141431 A1 Jun. 19, 2008

(30) Foreign Application Priority Data

Dec. 15, 2006 (GB) ..... 0625102.9
Apr. 5, 2007 (GB) ..... 0706766.3
Apr. 5, 2007 (GB) ..... 0706769.7

(51) Int. Cl.
*A41D 5/00* (2006.01)

(52) U.S. Cl. ..... 2/67; 2/69

(58) Field of Classification Search ..... 2/69, 67, 2/458, 2.15, 68, 401, 409, 238, 272, 400; 450/97, 109, 123, 132, 151
See application file for complete search history.

(56) References Cited

U.S. PATENT DOCUMENTS 2,072,184 A 3/1937 Rheinauer
2,527,224 A 10/1950 Landy
2,918,920 A 12/1959 Lutsky
3,333,589 A 8/1967 Cohen et al.
3,436,762 A * 4/1969 Cahan ..... 2/67
3,489,154 A 1/1970 Kaspar et al.
4,095,291 A 6/1978 Di Tullio
4,103,360 A 8/1978 Belpaume
4,179,754 A 12/1979 Denu
4,298,008 A 11/1981 Kylberg
4,343,044 A 8/1982 Borda et al.
4,494,546 A * 1/1985 Steiman ..... 450/8
4,571,742 A 2/1986 Wior (Continued)

FOREIGN PATENT DOCUMENTS

CA 2 235 561 10/1998

(Continued)

OTHER PUBLICATIONS

Office Action issued Feb. 25, 2010 for co-pending U.S. Appl. No. 11/839,870, United States Patent and Trademark Offie, Alexandria, Virginia.

(Continued)

*Primary Examiner* — Alissa L Hoey
(74) *Attorney, Agent, or Firm* — Stites & Harbison PLLC; Marvin Petry

(57) ABSTRACT

This application describes a garment (e.g. a swim suit) having a base layer of stretchable elasticated fabric, the base layer having a torso portion that covers at least a part of the torso of a person when the garment is worn. An inner core layer of stretchable elasticated fabric is bonded to the inner surface of the base layer to extend around the abdomen and lower back regions of the garment. By providing a double layer of stretchable elasticated fabric in this manner, more compression is applied to the abdomen of the person (e.g. swimmer) wearing the suit, bringing about improvements in form drag. The additional support provided to the lower back and abdomen also improves core stability, which is of benefit in many sporting activities, including swimming.

42 Claims, 2 Drawing Sheets

U.S. PATENT DOCUMENTS

| | | | | |
|---|---|---|---|---|
| 4,654,894 | A * | 4/1987 | Kudo | 2/67 |
| 4,698,847 | A * | 10/1987 | Yoshihara | 2/69 |
| 4,741,719 | A | 5/1988 | Wirth | |
| 4,781,651 | A | 11/1988 | Ekins | |
| 4,862,517 | A | 9/1989 | Meistrell | |
| 4,862,523 | A | 9/1989 | Lipov | |
| 4,910,802 | A | 3/1990 | Malloy | |
| 4,916,755 | A | 4/1990 | Feigenbaum et al. | |
| 4,946,453 | A | 8/1990 | Monson | |
| 4,956,878 | A | 9/1990 | Boynton | |
| 4,972,522 | A | 11/1990 | Rautenberg | |
| 4,986,496 | A | 1/1991 | Marentic et al. | |
| 4,999,845 | A | 3/1991 | Jenks et al. | |
| 5,033,116 | A | 7/1991 | Itagaki et al. | |
| 5,033,986 | A | 7/1991 | Feigenbaum et al. | |
| 5,052,053 | A | 10/1991 | Peart et al. | |
| 5,069,403 | A | 12/1991 | Marentic et al. | |
| 5,081,716 | A | 1/1992 | Lehenbauer et al. | |
| 5,119,511 | A | 6/1992 | Packer et al. | |
| 5,133,516 | A | 7/1992 | Marentic et al. | |
| 5,201,074 | A | 4/1993 | Dicker | |
| 5,263,923 | A | 11/1993 | Fujimoto | |
| 5,359,732 | A | 11/1994 | Waldman et al. | |
| 5,367,708 | A | 11/1994 | Fujimoto | |
| 5,447,462 | A | 9/1995 | Smith et al. | |
| 5,487,710 | A | 1/1996 | Lavorgna et al. | |
| 5,533,961 | A | 7/1996 | Iwata | |
| 5,603,116 | A | 2/1997 | Tronc | |
| 5,605,060 | A | 2/1997 | Osborne | |
| 5,640,714 | A | 6/1997 | Tanaka | |
| 5,699,559 | A | 12/1997 | Sano | |
| 5,700,231 | A | 12/1997 | Wilkinson | |
| 5,720,042 | A | 2/1998 | Wilkinson | |
| 5,734,990 | A | 4/1998 | Waring | |
| 5,742,936 | A | 4/1998 | Tronc | |
| 5,749,365 | A | 5/1998 | Magill | |
| 5,762,535 | A | 6/1998 | Nishiyama et al. | |
| 5,768,703 | A | 6/1998 | Machado et al. | |
| 5,778,452 | A | 7/1998 | Dicker et al. | |
| 5,819,322 | A | 10/1998 | Dicker et al. | |
| 5,829,057 | A * | 11/1998 | Gunn | 2/69 |
| 5,839,122 | A | 11/1998 | Dicker et al. | |
| 5,915,531 | A * | 6/1999 | Hilpert et al. | 2/69 |
| 5,937,442 | A | 8/1999 | Yamaguchi et al. | |
| 5,978,963 | A * | 11/1999 | Moskowitz et al. | 2/67 |
| 5,987,933 | A | 11/1999 | Metzler | |
| 5,996,120 | A | 12/1999 | Balit | |
| 6,047,405 | A | 4/2000 | Wilkinson | |
| 6,061,829 | A * | 5/2000 | Gunn | 2/69 |
| 6,061,832 | A * | 5/2000 | Morrison, Jr. | 2/78.1 |
| 6,098,198 | A | 8/2000 | Jacobs et al. | |
| 6,195,801 | B1 * | 3/2001 | Meyers | 2/67 |
| 6,292,947 | B1 | 9/2001 | Bechis | |
| 6,374,413 | B1 * | 4/2002 | Magee | 2/69 |
| 6,401,497 | B1 | 6/2002 | Nishiyama et al. | |
| 6,438,755 | B1 | 8/2002 | MacDonald et al. | |
| 6,446,264 | B2 | 9/2002 | Fairhurst et al. | |
| 6,484,319 | B1 | 11/2002 | Fusco et al. | |
| 6,526,584 | B1 | 3/2003 | Hunter | |
| 6,546,560 | B2 | 4/2003 | Fusco et al. | |
| 6,647,550 | B1 | 11/2003 | Matsuzaki et al. | |
| 6,694,185 | B2 | 2/2004 | Orton | |
| 6,698,903 | B2 | 3/2004 | Hall | |
| 6,817,030 | B2 | 11/2004 | Desai | |
| 7,074,204 | B2 | 7/2006 | Fujii et al. | |
| 7,089,597 | B2 | 8/2006 | Horii et al. | |
| 7,096,506 | B2 | 8/2006 | Ragot | |
| 7,229,390 | B2 | 6/2007 | Fujii et al. | |
| 7,395,553 | B2 | 7/2008 | O'Hara | |
| 7,549,971 | B2 * | 6/2009 | Bell et al. | 602/75 |
| 7,559,093 | B2 * | 7/2009 | Sudo et al. | 2/69 |
| D601,778 | S | 10/2009 | Rance et al. | |
| 7,631,367 | B2 | 12/2009 | Caillibotte et al. | |
| 7,670,205 | B2 * | 3/2010 | Oyama et al. | 450/97 |
| 7,670,666 | B2 * | 3/2010 | Deguchi | 428/141 |
| 2002/0069450 | A1 | 6/2002 | Mc Namara | |
| 2002/0108160 | A1 | 8/2002 | Griffiths | |
| 2002/0116740 | A1 * | 8/2002 | Saillet et al. | 2/2.15 |
| 2002/0152531 | A1 * | 10/2002 | Fusco et al. | 2/2.15 |
| 2003/0101506 | A1 | 6/2003 | Fujii et al. | |
| 2003/0140391 | A1 | 7/2003 | Richards et al. | |
| 2003/0208829 | A1 | 11/2003 | Ragot et al. | |
| 2004/0107479 | A1 | 6/2004 | Dicker et al. | |
| 2004/0111781 | A1 | 6/2004 | Miyake et al. | |
| 2004/0194189 | A1 * | 10/2004 | Liu | 2/69 |
| 2004/0234478 | A1 | 11/2004 | Clapp et al. | |
| 2005/0028241 | A1 | 2/2005 | Ragot | |
| 2005/0126229 | A1 | 6/2005 | Deguchi | |
| 2005/0142986 | A1 | 6/2005 | Belpaume | |
| 2005/0193461 | A1 | 9/2005 | Caillibotte et al. | |
| 2005/0198722 | A1 | 9/2005 | Nordstrom | |
| 2005/0223753 | A1 | 10/2005 | Nordstrom | |
| 2005/0229293 | A1 | 10/2005 | Miller | |
| 2005/0235465 | A1 | 10/2005 | Butz | |
| 2006/0272071 | A1 * | 12/2006 | Mickle | 2/69 |
| 2007/0006356 | A1 | 1/2007 | Shiue | |
| 2007/0022510 | A1 * | 2/2007 | Chapuis et al. | 2/69 |
| 2007/0033696 | A1 * | 2/2007 | Sellier | 2/69 |
| 2007/0050881 | A1 * | 3/2007 | Kasprzak | 2/69 |
| 2008/0066211 | A1 * | 3/2008 | Laugt et al. | 2/69 |
| 2008/0078008 | A1 | 4/2008 | Demarest et al. | |
| 2008/0141430 | A1 | 6/2008 | Rance et al. | |
| 2008/0256675 | A1 | 10/2008 | DiLorenzo | |
| 2008/0295216 | A1 * | 12/2008 | Nordstrom et al. | 2/69 |
| 2009/0031486 | A1 * | 2/2009 | Sokolowski et al. | 2/458 |
| 2009/0038047 | A1 | 2/2009 | DiLorenzo | |
| 2009/0113596 | A1 | 5/2009 | Young | |
| 2009/0126413 | A1 * | 5/2009 | Sorensen et al. | 66/196 |
| 2009/0300816 | A1 * | 12/2009 | Brito et al. | 2/67 |
| 2010/0017931 | A1 * | 1/2010 | Whaley | 2/67 |

FOREIGN PATENT DOCUMENTS

| | | |
|---|---|---|
| EP | 0 354 022 | 2/1990 |
| EP | 0 875 161 | 11/1998 |
| EP | 1 179 301 | 2/2002 |
| EP | 1 250 858 | 10/2002 |
| FR | 2 740 662 | 5/1997 |
| FR | 2 865 904 | 8/2005 |
| GB | 515219 | 11/1939 |
| GB | 996051 | 6/1965 |
| GB | 1 508 597 | 4/1978 |
| GB | 2 273 646 | 6/1994 |
| GB | 2 411 816 | 9/2005 |
| JP | 1-213403 | 8/1989 |
| JP | 8-120507 | 5/1996 |
| JP | 8-311751 | 11/1996 |
| JP | 9-111514 | 4/1997 |
| JP | 9-119003 | 5/1997 |
| JP | 11-100705 | 4/1999 |
| JP | 11-152610 | 6/1999 |
| JP | 2001-032104 | 2/2001 |
| JP | 2001-262409 | 9/2001 |
| JP | 2003-041464 | 2/2003 |
| JP | 2003-239113 | 8/2003 |
| JP | 2003-328212 | 11/2003 |
| JP | 2004-124325 | 4/2004 |
| JP | 2004-156153 | 6/2004 |
| WO | WO 98/18354 | 5/1998 |
| WO | WO 98/32347 | 7/1998 |
| WO | WO 99/04660 | 2/1999 |
| WO | WO 99/23903 | 5/1999 |
| WO | WO 00/45658 | 8/2000 |
| WO | WO 2005/039336 | 5/2005 |
| WO | WO 2005/112674 | 12/2005 |
| WO | WO 2006/043476 | 4/2006 |

OTHER PUBLICATIONS

Tokugikon, Jan. 25, 2002, No. 221, pp. 1-8/E.

Search Report for GB 0715652.4, Dec. 21, 2007, UK Intellectual Property Office.

Search and Examination Report for GB 0715653.2, Dec. 24, 2007, UK Intellectual Property Office.

Examiner's First Report on Patent Application No. 2007207872, Jun. 18, 2009, AU Intellectual Property Office.

Examiner's First Report on Patent Application No. 2007207873, Jun. 18, 2009, AU Intellectual Property Office.

Office Action issued Jul. 9, 2010 in co-pending U.S. Appl. No. 11/839,870, United States Patent and Trademark Office, Alexandria, Virginia.
Office Action issued Dec. 10, 2010 in co-pending U.S. Appl. No. 11/839,870, United States Patent and Trademark Office, Alexandria, Virginia.
Office Action issued Jan. 14, 2010 in co-pending U.S. Appl. No. 11/839,870, United States Patent and Trademark Office, Alexandria, Virginia.

* cited by examiner

GARMENTS

FIELD OF THE INVENTION

This invention has to do with garments that incorporate elastic stretch fabric and fit tightly to the body, typically for sports use. Particular examples are described in relation to swimsuits, which is a preferred use. However, the concepts described can be applied to other sports and athletic garments including, for example, beach volley, waterpolo and triathlon wear.

BACKGROUND

A number of known sports garments, especially racing swimsuits, are made from elasticated stretch fabric which fits closely and tightly against the body. In recent years use has been made of various fabrics with high elastane content having a high stretch constant to press more firmly against the body surface for a given degree of stretch. In racing swimsuits this reduces the entry of water between the suit and body—a source of drag—and avoids the sliding of the fabric over the skin. It can also reduce muscle vibration which is believed to be a cause of fatigue and body drag in swimming.

In our earlier applications EP-A-1110464 and EP-A-1250858 we describe swimsuits that provide an improved, highly-tensioned fit over the body, especially lower back and abdominal fit, using a special disposition of seams joining panels of elasticated stretch fabric that make up the swimsuit. The introduction of a seam across a span of stretch fabric was shown to reduce the stretchability, i.e. potentially increase a degree of tensioning, in a direction transverse to the seam.

SUMMARY OF THE INVENTION

The present invention is generally concerned with structures for swimsuits (and other tight-fitting outer garments, especially sports garments) that can offer improved performance for competitive swimmers through a reduction in surface drag, a reduction in form drag and/or improved stability in the water.

In a first aspect the invention provides a garment having:

a base layer of stretchable elasticated fabric that covers at least the torso; and an inner core layer of stretchable elasticated fabric bonded to the inner surface of the base layer to extend around the abdomen and lower back regions of the garment.

By providing a double layer of stretchable elasticated fabric in this manner, more compression is applied to the abdomen of the person (e.g. swimmer) wearing the suit, bringing about improvements in form drag. The additional support provided to the lower back and abdomen also improves core stability, which is of benefit in many sporting activities, including swimming.

The inner core layer preferably extends upwardly on the front of the torso as far as the diaphragm (or lower ribs). On the rear of the torso, it preferably extends upwardly to cover the whole of the lumbar region. It is preferable that the inner core layer stops short of the chest on the front, so it does not impede breathing at all, and that it stops short of the lower ends of the scapula on the rear of the suit so that it does not impede movement of the shoulders and arms.

At its lower end, the inner core layer preferably extends down to the crotch, both at the back and the front of the suit. The front and back parts of the inner core layer may join one another in the crotch region. Preferably they also join at both sides of the suit so that the core layer extends all of the way around the torso in a continuous band.

Preferably, however, lateral sides of the inner core layer do not extend beyond the hip, a lower edge of the inner core layer having a concavely curved form over each hip region to extend further downwardly to the front and back than on the hip itself, so as not to unduly restrict movement of the legs.

At the rear of the suit the inner core layer may extend downwardly to cover the buttock region (e.g. to entirely cover or even extend below the buttock 'cheeks', i.e. gluteal muscles), in order to compress the buttocks to improve form drag.

In the case of a swimsuit intended for use by a swimmer performing the breaststroke, where a large degree of hip articulation is necessary, the inner core layer may terminate at its lateral sides above the hip, to allow even greater freedom of movement.

The elastic stretch fabric used to make the base layer of the garment may be of any suitable kind. Fabrics of high stretch constant, e.g. polyester elastanes as conventionally used for making high-performance swimwear, are within the skilled person's routine knowledge.

The inner core layer may be formed of the same material as the base layer of the garment.

In preferred embodiments of this first aspect of the invention, the garment preferably has a plurality of panels laminated on the outer surface of the base layer in the manner described in our co-pending GB0625102.9. The panels preferably cover 20% or more of the torso and more preferably cover 25%, 30%, 35%, 40%, 45% or even 50% or more of the torso. In some preferred embodiments, the panels cover 20% or more of the rear of the torso and may cover as much 30%, 40% or even 50% or more of the rear of the torso. It is particularly preferred that the panels cover at least 50% of the front of the torso and in some embodiments may cover as much as 60%, 70% or 80% or more of the front of the torso. In some embodiments the panels will cover more of the front of the torso than of the rear of the torso.

Competition swimsuits (and some other sports garments) often also cover either the whole or part of an athlete's legs. In such garments, the legs preferably also have one or more panels laminated on their outer surface. The panels may cover 50% or more of each leg. For example, the panels may cover substantially all of the upper leg.

As explained in our co-pending GB0625102.9, the panels applied to the torso and/or limbs are preferably formed of a material having a higher stretch constant than that of the underlying base layer and are applied to areas of the torso in which it is desired for the suit to be more tensioned when worn to provide greater support and/or to reduce the form of the underlying part of the athlete's (e.g. swimmer's) torso, to reduce form drag in the water. The material from which the panels are formed preferably has an outer surface that is more 'slippery' (i.e. exhibits lower surface drag in water) than the underlying base layer, so water flows over it more quickly that it would over the base layer alone (i.e. it is a "fast fabric"). In this way, the surface drag of the overall suit is reduced by application of the panels, especially where the panels cover a substantial percentage of the surface of the suit.

In garments with arms it is generally preferable to ensure that the athlete's arms have as much freedom as possible to move. Preferably, therefore, where the garment has arms, the arms of the suit are made from a lightweight fabric (either the same fabric as the suit torso or a lighter weight fabric) and there are no panels laminated onto the arms. In some embodiments the arms may be made from a heavier fabric that the suit torso.

Preferred materials for these panels are as described below in the context of the second aspect.

More generally, the swimsuit (or other sports wear) may cover e.g.

(i) the whole body, including the full length of the arms and legs;

(ii) as (i) but not the arms;

(iii) as (i) or (ii) but not the legs, or the legs only down to knee-length;

(iv) the torso only, i.e. no arms or legs.

In a second aspect the invention provides a cap (e.g. a swim cap) having a base layer of stretchable elasticated fabric and one or more panels laminated on the outer surface of the base layer, the panels covering 25% or more of the cap.

In this aspect, the panels preferably cover 50% or more of the cap, more preferably 75%, 80%, 85%, 90% or more.

The panels are preferably formed of a material having an outer surface that is more 'slippery' (i.e. exhibits lower surface drag in water) than the underlying base layer. In this way, the surface drag of the overall cap is reduced by application of the panels compared with a plain fabric cap, especially where the panels cover a substantial percentage of the surface of the cap.

Preferred embodiments of the cap include a panel extending front to back across the top of the cap. This top panel preferably has a rectangular form towards the front with a front edge of the panel being arranged substantially parallel to the rim of the cap at the front. In contrast, the rear end of the top panel is preferably tapered, most preferably tapered to a point.

The cap preferably includes a pair of side panels, one to each side of the cap. The side panels may be generally semi-circular in shape, preferably with a bottom edge that is substantially parallel to the rim of the cap along the respective side.

The cap preferably includes both a top panel and two side panels. In this case, the top edge of each side panel may be generally parallel to the respective side edge of the top panel, preferably spaced slightly therefrom.

Suitable materials for the panels include polyurethane sheet material. The properties of the polyurethane material (or other equivalent material) can be selected to give the desired stretch characteristics.

For currently envisaged applications, preferred properties include a material weight in the range 70 g/m$^2$ to 110 g/m$^2$, more preferably 80 g/m$^2$ to 100 g/m$^2$, even more preferably 85 g/m$^2$ to 95 g/m$^2$, for example 90 g/m$^2$. The thickness of the sheet material is preferably in the range 50 microns to 100 microns, more preferably 60 microns to 90 microns and even more preferably 70 microns to 80 microns, for example 75 or 76 microns.

Exemplary polyurethane materials include two layer polyurethane films, with an adhesive layer (for adhering to the underlying garment fabric) and a thick film face side layer, which may have a matt finish. The adhesive layer may provide ⅔ of the overall sheet thickness. The adhesive preferably has a softening point in the range 60° C. to 80° C., for example 72° C. (TMA onset temperature). The service temperature range of the adhesive is preferably at least −20° C. to 60° C. and more preferably −40° C. to 75° C.

Whilst the panels may all have the same properties, in some applications they may advantageously have different properties from one another (e.g. different stretch constants, for instance as a result of having different weights and/or thicknesses) to provide greater tailoring over the athlete's head.

The base layer of the cap is generally dome shaped in its finished form to cover a majority of the head of the wearer. The bottom edge of the base layer is preferably shaped to curve upwardly from both sides to the nape of the neck at the rear. On the sides of the cap, the bottom edge preferably has a convexly curved shape to extend down over the ears. The front of the cap may have a gentle concave curvature to generally follow the line of the brow.

The base layer may be formed by a series of connected panels, which when joined together provide the desired dome shape. Preferably the panels are joined by bonded seams.

To provide differential stretch characteristics over the surface of the cap, in addition to providing laminated panels on the outside surface of the base layer, it may also be desirable to laminate one or more panels to the inside surface of the base layer. For instance, additional internal panels can be added in the region of the base layer covering the ears to increase the tension in this area to provide a better fit over the ears. The areas of fabric covering the ears may, if desired, be perforated to minimise the effect on the wearers hearing.

The internal panels can be formed of the same fabric material as the base layer.

The elastic stretch fabric used to make the cap may be of any suitable kind. Fabrics of high stretch constant, e.g. polyester elastanes as conventionally used for making high-performance swimwear, are within the skilled person's routine knowledge.

To improve fit and comfort and to more securely hold the cap in place (e.g. when performing 'tumble turns' in water), the cap preferably has an elasticated band around it's rim, e.g. bonded to the inside surface of the base layer. The band may, for instance, be a silicone coated elastic.

BRIEF DESCRIPTION OF THE DRAWINGS

Preferred embodiments of the two aspects of the invention are now described by way of example as applied to racing swimsuits and caps, with reference to the accompanying drawings in which.

DETAILED DESCRIPTION

Swimsuit

Figure 1:
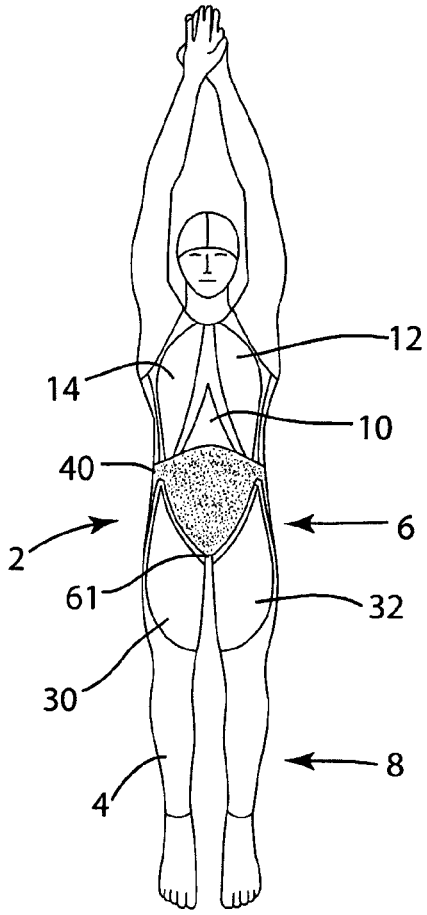
FIG. 1 is a front view of a full body suit with no arms comprising an inner core in accordance with an embodiment of the first aspect of the present invention.
Figure 2:
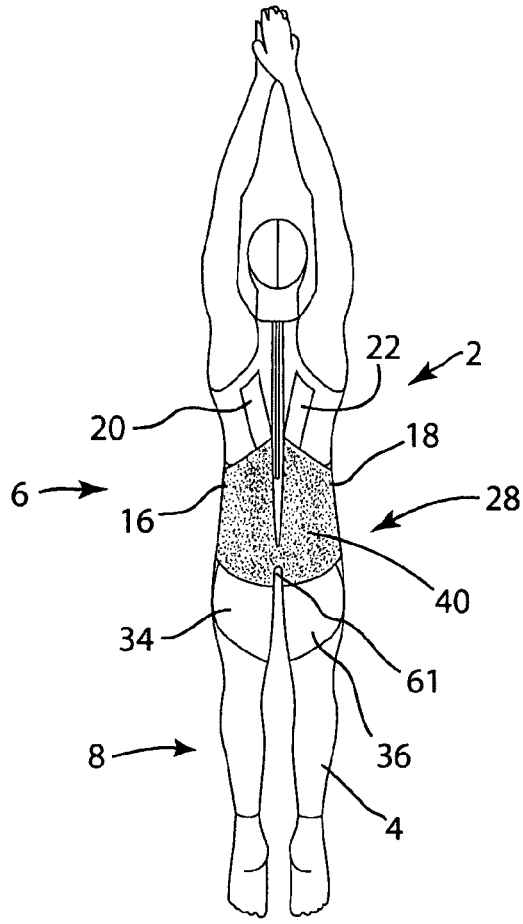
FIG. 2 is a back view of the FIG. 1 suit.
Figure 3:
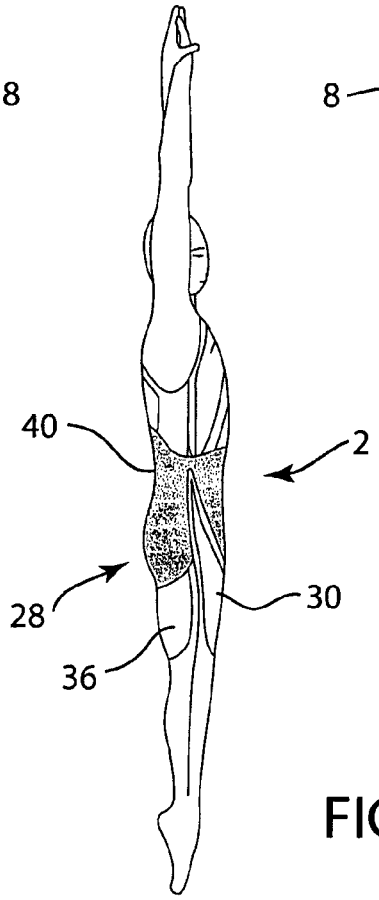
FIG. 3 is a side view of the FIG. 1 suit.
Figure 4:
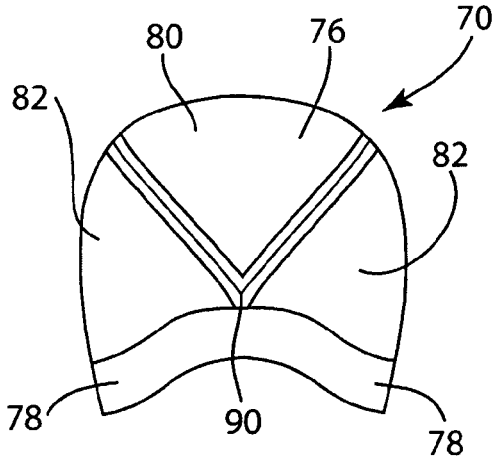
FIG. 4 is a back view of a swim cap in accordance with an embodiment of the second aspect of the invention.
Figure 5:
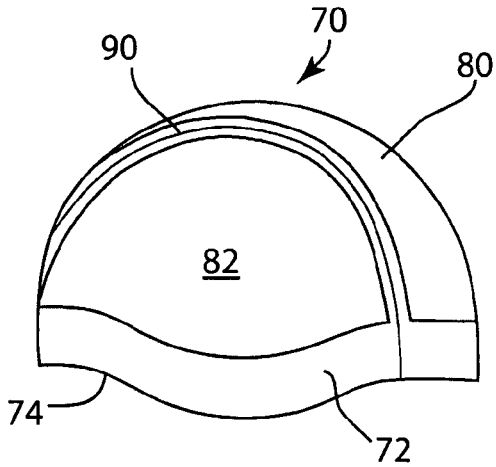
FIG. 5 is a side view of the FIG. 4 cap.
Figure 6:
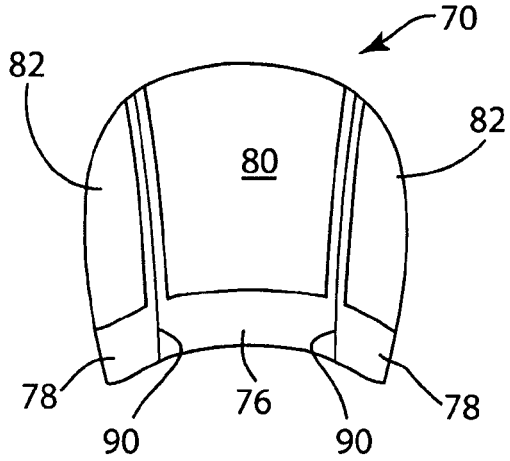
FIG. 6 is a front view of the FIG. 4 cap.

The swimsuit illustrated in FIGS. 1 to 3 is made from a base layer of high stretch constant elastane fabric of a known kind. The illustrated example is a full body suit 2, the base layer 4 of which covers and fits closely over the entire torso 6 and also the legs 8 to the ankles. In this example the suit has no arms but the principles illustrated are applicable also to arms with suits.

The base layer may be formed from multiple sections joined to one another. The sections may be joined by stitching, as described, for example, in our EP-A-1110464. More preferably, however, adjacent sections of the base layer are bonded to one another. Such bonded seams have been found to have particularly low profiles and resultant low drag properties in water.

As is normal, the suit has a zip fastener extending down the centre of the back of the suit to allow a swimmer to don and take off the suit. Preferably the zip fastener has a low profile and is bonded to the sections of the suit that it joins to minimise the drag.

In accordance with the first aspect of the present invention, as schematically shown in the figures with shaded regions, the suit includes an inner core 40 formed by a layer of fabric bonded to the inner surface of the base layer of the suit in the lower trunk region. The fabric may be the same as that used for the base layer, i.e. a conventional elastane fabric.

The inner core 40 extends substantially completely around the torso, providing a continuous band across the abdomen, around the flanks of the torso and across the lumbar region of the back to either side of the zip fastener.

On the front of the suit, the upper edge of the inner core 40 extends slightly further up in the midline of the torso than at the lateral sides of the torso, generally following the line of the diaphragm (i.e. lower ribs). On the rear of the suit, the upper edge of the inner core likewise extends up from either side towards the midline of the back. It extends upwards from just above the waist at the sides of the trunk to just below the lower points of the scapula at the midline.

The lower edge of the inner core 40 extends down around the crotch 61 in the centre at both the back and the front, the front and rear portions joining at this point. At the rear, the lower edge of the inner core 40 extends upwardly from the crotch 61 towards the lateral sides of the suit in a convex sweep, generally following the lines of the buttocks to the midline of the lateral side of the suit but then rises vertically to join the front portion of the core over the hip at a joining region. At the front of the suit, the inner core 40 sweeps upwardly from the crotch 61 to the hip with a concave curve.

The inner core 40 provides additional tension in the suit around the swimmer's midriff, helping to flatten the abdomen and buttocks, reducing form drag, and providing additional support to improve core stability.

The suit also has panels of a polyurethane material laminated on the outer surface of the base layer at selected locations, in the manner described in our co-pending GB0625102.9. The specially-shaped panels provide areas of reduced surface drag and/or greater compression and/or support of a swimmer's body without inhibiting the swimmer's stroke. The selective support provided by the laminated panels can help support and maintain the form of the swimmer's stroke.

In this example, the polyurethane material is a two layer polyurethane film, with an adhesive layer (for adhering to the underlying garment fabric) and a thick film face side layer, which may have a matt finish (other finishes are possible). The material has a weight of about 90 g/m$^2$ and an overall thickness of about 76 microns, with the adhesive layer providing ⅔ of the overall thickness. The adhesive has a softening point of 72° C. (TMA onset temperature) and a service temperature range of −40° C. to 75° C.

The torso region 6 of the suit 2 has three panels on the front, an abdominal panel 10 and left- and right-side chest panels 12, 14. In some embodiments, the chest panels may be omitted. On the rear or the torso region 6 there are left- and right-side lumbar panels 16, 18 and left- and right-side back panels 20, 22, which in this example extend from and are formed integrally with the lumbar panels 16, 18. In some embodiments the lumbar and/or back panels may be omitted.

The abdominal panel 10 is generally rhomboidal in shape. A bottom corner of the panel 10 extends down to the crotch region 61 of the suit. A top corner of the panel extends up to the sternum region. Left and right corners of the panel extend laterally towards the side of the torso region 6, terminating just short of the mid-line of the side of the torso. The abdominal panel 10 provides an area of low surface drag as well as providing, in combination with the underlying inner core, a highly tensioned region to give greater core stability.

The chest panels 12, 14 are symmetrical with one another about the centre line of the front of the suit. The right-side chest panel 14 is generally triangular in shape. It has a medial side edge that extends from the neck opening down to a point at the bottom end of the panel adjacent to but spaced from the left-side corner of the abdominal panel 10. The side edge is slightly convex in shape. A lateral side edge of the chest panel 14 extends generally vertically from the bottom end of the chest panel 14 to a position close to the lower edge of the right arm opening of the suit. A top side edge of the chest panel 14 extends in a convex curve from the top end of the lateral side edge to the neck opening at a point close to but laterally outward from the top end of the medial side edge. The left-side chest panel 12 is a mirror image of the right-side chest panel 14.

The chest panels 12, 14 are configured to avoid restricting the swimmer's lung function. This may be achieved through appropriate shaping of the panels and/or through selection of a material with an appropriate stretch constant. The material may be the same as used for other panels on the suit. If needs be, however, the chest panels may be formed of a material having a lower stretch constant that the abdominal panel 10 (and the other panels discussed below) so they are less tensioned when the suit is worn in order that they do not overly restrict the swimmer's breathing. In other embodiments the abdominal panel may have a lower stretch constant that the chest panels.

The chest panels 12, 14 serve to flatten the swimmer's chest, reducing form drag, as well as providing further areas of low surface drag.

The lumbar panels 16, 18 are generally trapezoidal in shape, with (taking the right-side panel as an example) generally vertical medial and lateral side edges and top and bottom edges that rise upwardly on the torso in the lateral direction. The lower part of the lumbar panel 18 extends down over the buttock area 28. The bottom edge is slightly convexly curved to generally follow the lower edge of the swimmer's buttock (gluteus maximus). The top edge is generally in line with the lowermost rib. The left-side lumbar panel 16 is a mirror image of the right-side panel 18.

The two lumbar panels 16, 18 meet one another at a lower end portion of their respective medial sides edges, at the crotch region 61. The medial side edges diverge slightly from one another towards the upper edge of the panels.

The lumbar panels 16, 18 provide highly tensioned areas to support the lumbar region, improving core stability. They also compress the swimmer's buttocks, reducing form drag and provide large surface areas of the suit with low surface drag.

As can be seen in the figures, the lumbar panels overlap the portion of the base layer to which the inner core is bonded, the lower edges of the inner core and the lumbar panels overlying one another and the top edges terminating at a similar position up the back.

The right-side back panel 22 has the form of narrow oblong extending from the centre line of the back of the suit adjacent the top edge of the lumbar panel 18 diagonally outwardly across the back to the arm opening, generally adjacent a lower edge of the scapula. The upper end of the back panel 22 is laterally spaced from the centre line of the back of suit by a distance that is about one third of the distance between the back centre line and the centre line of the right-side of the suit. This leaves a relatively large panel-free torso portion of the suit under the arm opening between the top edge of the lumbar pad, the lateral side edge of the right-side chest panel 14 and the back panel 22. In use this arrangement provides support for the upper back whilst enabling relatively free twisting of the upper back and shoulder girdle of a swimmer, necessary for execution of the freestyle (front crawl) stroke. This, in turn, encourages correct execution of the stroke.

The left-side back panel 20 is a mirror image of the right-side back panel 22.

On each leg there is an upper leg panel that wraps around the inside of the leg from the front to the rear, comprising a quadriceps ('quad') panel portion 30, 32 on the front of the thigh (upper leg) and a hamstring panel portion 34, 36 on the rear of the upper leg. There may also be a lower leg panel on each leg, although the illustrated example does not include these panels, which wraps around the inside of the leg, comprising a calf panel portion on the rear of the lower leg and a shin panel portion on the front of the lower leg. The panels on the left leg are a mirror image of the panels on the right leg.

Looking at the right leg of the illustrated suit, the quad panel portion 30 has a lateral side edge that extends in a convex sweeping line from the inside of the leg just above the patella out to the lateral side of the leg and up to a point at the hip, generally following the outline of the quadriceps muscle group. A top edge of the quad panel portion extends from the top point to an inner leg region adjacent the crotch region 61. The quad panel portion 30 covers substantially the whole of the quadriceps muscle group, applying compression to the muscles to enhance the power generated by them. The panel also helps to reduce surface drag over the front of the upper leg.

The hamstring panel portion 36 is generally trapezoidal in shape. It extends across the full width of the rear upper part of the leg, extends down to just above the rear of the knee joint at the inside of the leg and extends up to just below the buttock. The upper edge of the panel portion 36 is convexly curved and is spaced from but closely follows the line of the bottom edge of the lumbar panel 18. The bottom edge of the hamstring panel portion is gently curved, concavely, to rise up towards the lateral side of the leg where it merges into the lateral side edge, which extends, also in a gently convex curve, to meet the lateral end of the upper edge at an acute angle.

The hamstring panel portion applies compression to the hamstring muscles in use to enhance the power generated by those muscles. It also helps to reduce surface drag over the rear of the leg.

The quadriceps and hamstring panel portions 30, 36 wrap around the inside of the leg to meet one another, forming one continuous panel wrapping around the inside of the upper leg. Opposite ends of the panel terminate on the outside of the leg, spaced from one another to either side of a seam running down the outside of the leg.

Swim Cap

Turning to FIGS. 4 to 9, a swim cap 70 in accordance with an embodiment of the second aspect of the invention will be described.

The cap 70 has a generally dome shaped base layer 72. The bottom edge 74 of the base layer 72 is shaped to extend down over the swimmer's ears at the sides, to generally follow the line of the user's brow at the front, in a sweeping concave curve, and to rise up in a convex curve at the rear, to be clear of the nape of the swimmer's neck. The latter feature in particular helps prevent any restriction in the articulation of the wearers neck as they tip their head backwards.

The base layer is formed from three sections, a centre section 76 and two side sections 78, that are joined at bonded seams, which run from front to back.

In this example, the cap also has three panels 80, 82 of a polyurethane material laminated on the outer surface of the base layer at selected locations, one on each of the base layer sections, spaced from the bonded seams and from the lower rim of the cap.

Specifically, there is a top panel 80 and two side panels 82, one to each side of the cap. Other embodiments may have more than three panels, e.g. 4 or 5 panels or more.

Looking at the present three panel example, the top panel 80 extends front to back across the top of the cap. It has a rectangular form towards the front with a front edge of the top panel 80 being substantially parallel to but spaced a short distance from the rim 74 of the cap at the front. The rear end of the top panel 80 tapers to a point, spaced a short distance from the rim 74 of the cap at the back. The side edges of the top panel 80 follow the lines of the bonded seams 90 in the base layer.

The side panels 82 are generally semi-circular in shape, with top edges that follow the lines of the bonded seams 90 of the base layer and bottom edges that are substantially parallel to but spaced from the rim 74 of the cap along the respective sides.

Figure 7:
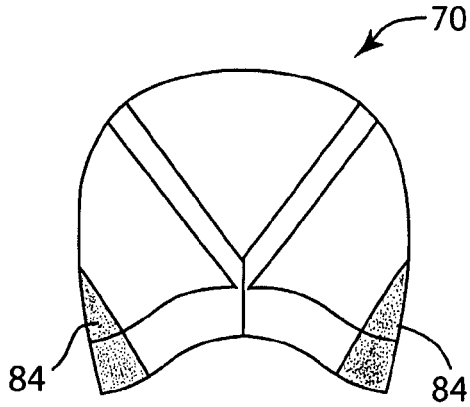
FIG. 7 is another back view of the FIG. 4 cap, showing the position of internal laminate fabric panels.
Figure 8:
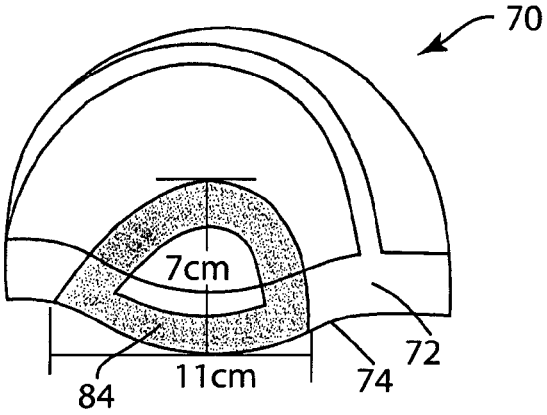
FIG. 8 is another side view of the FIG. 4 cap, showing the position of internal laminate fabric panels.
Figure 9:
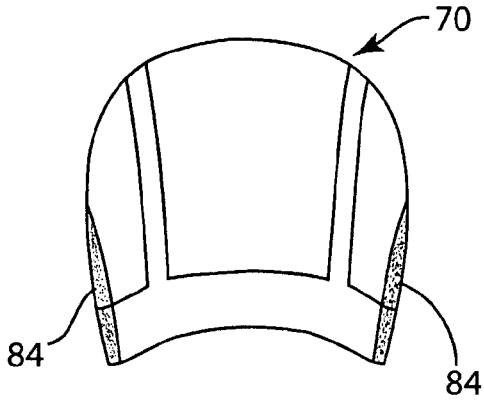
FIG. 9 is another front view of the FIG. 4 cap, showing the position of internal laminate fabric panels.

Looking specifically at FIGS. 7 to 9, it can be seen that the cap also includes two internal panels 84 bonded to the inside surface of the base layer (shown schematically with shaded areas). These panels are made of an elastane fabric, which may be the same as the base layer itself. They provide areas of increased tension to improve fit.

Specifically, in this example, left and right side, internal panels 84 are provided, which are generally semi-circular, as with the outside side panels 82, but are smaller than the outside side panels 82 and cover only the portion of the base layer that overlies the wearer's ears. They extend right down to the rim 74 of the cap.

As seen in FIG. 8, a centre portion 86 of each internal side panel 84 is cut away. The base layer still covers the ear, as does part of the outer side panel 82, but the cut away centre portion 86 of the inner panel 84 avoids covering the ear canal with three layers of fabric, which might undesirably inhibit the swimmer's hearing.

The skilled person will appreciate that the suit and cap illustrated in the figures and described above are examples embodying inventive concepts described herein and that many and various modifications to the specifically described suits can be made without departing from the invention. For instance, whilst the inventive concepts have been exemplified with full body, armless suits, the general principles as well as the specific panels described can be used with other styles of suit (e.g. full body with arms, torso only suits, long-johns, etc). The principles exemplified above can also be applied to other specialist sports garments, especially wet sports such as waterpolo and triathlon and beach sports such as beach volley.

The invention claimed is:

1. A garment adapted to be worn by a wearer, comprising, as defined by the location of the garment on a wearer, a base layer of a stretchable elasticated fabric, said base layer covering at least a part of the torso of the wearer, the base layer having a hip region overlying the hips of the wearer, said base layer extending upwardly beyond the lowermost ribs of the wearer and downwardly to below the crotch region of the wearer, the base layer having an outer surface and an inner surface, and an inner core layer formed of stretchable elasticated fabric and bonded to said inner surface of the base layer over only a portion of said inner surface, the inner core layer having a front part overlying the abdomen of the wearer and a back part overlying the lower back of the wearer, the front and back parts joining at joining regions located at lateral sides of the garment above the hips of the wearer, wherein the front part and the back part are separated from and not connected to each other, at all points below said joining regions, the front part, the back part and the joining regions, taken together, extending continuously all the way around the torso of the wearer, wherein the lower ends of both the front part and the back part of the inner core layer extend down to the crotch region of the wearer.

2. A garment according to claim 1, wherein the inner core layer is be formed of the same stretchable elasticated fabric as the base layer of the garment.

3. A garment according to claim 1, wherein the elasticated fabric of the inner core layer comprises a polyester elastane.

4. A garment according to claim 1, comprising a plurality of panels laminated on the outer surface of the base layer.

5. A garment according to claim 4, wherein the panels cover 20% or more of the torso portion of the base layer.

6. A garment according to claim 4, wherein the panels cover 20% or more of a rear side of the torso portion of the garment.

7. A garment according to claim 4, wherein the panels cover at least 50% of a front side of the torso portion of the garment.

8. A garment according to claim 4, wherein the panels cover more of a front side of the torso portion of the garment than of a rear side of the torso portion of the garment.

9. A garment according to claim 4, wherein the garment has a pair of leg portions that cover at least a part of the wearer's legs, each leg portion having one or more panels laminated on their outer surface.

10. A garment according to claim 9, wherein the panels cover 20% or more of each leg portion.

11. A garment according to claim 4, the garment comprising a pair of arm portions for covering at least part of the wearer's arms, the arm portions being free of any laminated panels.

12. A garment according to claim 4, wherein the panels applied to the base layer are formed of a material having a higher stretch constant than that of the underlying base layer.

13. A garment according to claim 4, wherein the panels are formed of a material having an outer surface that exhibits lower surface drag in water than the underlying base layer.

14. A garment according to claim 4, wherein the panels comprise polyurethane sheet material.

15. A garment according to claim 4, wherein one or more of the panels have different material properties than one another.

16. A garment according to claim 4, wherein the panels are applied to one or any combination of two or more of the following panel locations:

a) on the front of the suit covering the wearer's abdomen;

b) extending across the wearer's lumbar region;

c) extending over the wearer's buttocks;

d) covering the wearer's chest;

e) extending over the wearer's quadriceps muscle group on the front of the wearer's thigh;

f) extending over the wearer's hamstring muscle group on the rear of the wearer's thigh;

g) extending over the wearer's shin;

h) extending over the wearer's calf;

i) on the back extending from the center of the wearer's back in the lumbar region upwardly towards the wearer's shoulders; and j) on the wearer's back, spaced to either side of the wearer's spine, to wrap around from the wearer's back to the lateral sides of the wearer's trunk below the wearer's arms.

17. A garment according to claim 1, wherein the front part of the inner core layer extends upwardly at least as far as the diaphragm or lower ribs of the wearer.

18. A garment according to claim 1, wherein the back part of the inner core layer extends upwardly far enough to cover the lumbar region of the wearer.

19. A garment according to claim 1, wherein a front part of the inner core layer stops short of the chest of the wearer.

20. A garment according to claim 1, wherein the back part of the inner core layer stops short of the scapula of the wearer.

21. A garment according to claim 1, wherein front and back parts of the inner core layer join one another at the crotch region of the wearer.

22. A garment according to claim 1, wherein the edges of the front and back parts below the joining regions each have a concavely curved form which extends downwardly to below the wearer's hips.

23. A garment according to claim 1, wherein the back part of the inner core layer extends downwardly to cover a buttock region of the wearer.

24. A garment adapted to be worn by a wearer, comprising, as defined by the location of the garment on a wearer, a base layer of a stretchable elasticated fabric, said base layer covering at least a part of the torso of the wearer, the base layer having a hip region overlying the hips of the wearer, said base layer extending upwardly beyond the lowermost ribs of the wearer and downwardly to below the crotch region of the wearer, the base layer having an outer surface and an inner surface, and an inner core layer formed of stretchable elasticated fabric and bonded to said inner surface of the base layer over only a portion of said inner surface, the inner core layer having a front part overlying the abdomen of the wearer and a back part overlying the lower back of the wearer, the front and back parts joining at joining regions located at lateral sides of the garment above the hips of the wearer, wherein the front part and the back part are separated from and not connected to each other, at all points below said joining regions, the back part of the inner core layer extending downwardly to cover the buttock region of the wearer, the front part, the back part and the joining regions, taken together, extending continuously all the way around the torso of the wearer, wherein the lower ends of both the front part and the back part of the inner core layer extend down to the crotch region of the wearer.

25. A garment according to claim 24, wherein the inner core layer is be formed of the same stretchable elasticated fabric as the base layer of the garment.

26. A garment according to claim 24, wherein a front part of the inner core layer stops short of the chest of the wearer.

27. A garment according to claim 24, wherein the back part of the inner core layer stops short of the scapula of the wearer.

28. A garment according to claim 24, wherein front and back parts of the inner core layer join one another at the crotch region of the wearer.

29. A garment according to claim 24, wherein the edges of the front and back parts below the joining regions each have a concavely curved form which extends downwardly to below the wearer's hips.

30. A garment adapted to be worn by a wearer, comprising, as defined by the location of the garment on a wearer, a base layer of a stretchable elasticated fabric, said base layer covering at least a part of the torso of the wearer, the base layer having a hip region overlying the hips of the wearer, said base layer extending upwardly beyond the lowermost ribs of the wearer and downwardly to below the crotch region of the wearer, the base layer having an outer surface and an inner surface, and an inner core layer formed of stretchable elasticated fabric and bonded to said inner surface of the base layer over only a portion of said inner surface, the inner core layer having a front part overlying the abdomen of the wearer and a back part overlying the lower back of the wearer, the front and back parts joining at joining regions located at lateral sides of the garment above the hips of the wearer, wherein the front part and the back part are separated from and not connected to each other, at all points below said joining regions, the front and back parts of the inner core layer extending down to and joining one another at the crotch region of the wearer, the front part, the back part and the joining regions, taken together, extending continuously all the way around the torso of the wearer.

31. A garment according to claim 30, wherein the inner core layer is be formed of the same stretchable elasticated fabric as the base layer of the garment.

32. A garment according to claim 30, wherein a front part of the inner core layer stops short of the chest of the wearer.

33. A garment according to claim 30, wherein the back part of the inner core layer stops short of the scapula of the wearer.

34. A garment according to claim 30, wherein the edges of the front and back parts below the joining regions each have a concavely curved form which extends downwardly to below the wearer's hips.

35. A garment adapted to be worn by a wearer, comprising, as defined by the location of the garment on a wearer, a base layer of a stretchable elasticated fabric, said base layer covering at least a part of the torso of the wearer, the base layer having a hip region overlying the hips of the wearer, said base layer extending upwardly beyond the lowermost ribs of the wearer and downwardly to below the crotch region of the wearer, the base layer having an outer surface and an inner surface, an inner core layer formed of stretchable elasticated fabric and bonded to said inner surface of the base layer over only a portion of said inner surface, the inner core layer having a front part overlying the abdomen of the wearer and a back part overlying the lower back of the wearer, the front and back parts joining at joining regions located at lateral sides of the garment above the hips of the wearer, wherein the front part and the back part are separated from and not connected to each other, at all points below said joining regions, the front part, the back part and the joining regions, taken together, extending continuously all the way around the torso of the wearer, wherein at the lower ends of both the front part and the back part of the inner core layer extend down to the crotch region of the wearer, and wherein the garment further comprises a plurality of panels laminated on the outer surface of the base layer and wherein the panels cover more of a front side of the torso portion of the garment than of a rear side of the torso portion of the garment.

36. A garment according to claim 35, wherein the front part of the inner core layer extends upwardly at least as far as the diaphragm or lower ribs of the wearer.

37. A garment according to claim 35, wherein the back part of the inner core layer extends upwardly far enough to cover the lumbar region of the wearer.

38. A garment according to claim 35, wherein a front part of the inner core layer stops short of the chest of the wearer.

39. A garment according to claim 35, wherein the back part of the inner core layer stops short of the scapula of the wearer.

40. A garment according to claim 35, wherein front and back parts of the inner core layer join one another at the crotch region of the wearer.

41. A garment according to claim 35, wherein the edges of the front and back parts of the inner core layer below the joining regions each have a concavely curved form which extends downwardly to below the wearer's hips.

42. A garment according to claim 35, wherein the back part of the inner core layer extends downwardly to cover a buttock region of the wearer.

* * * * *